US006673219B1

(12) United States Patent
Marttila

(10) Patent No.: US 6,673,219 B1
(45) Date of Patent: Jan. 6, 2004

(54) TRANSVERSE CONVEYOR FOR ELECTRODES

(75) Inventor: Tom Marttila, Espoo (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/787,515

(22) PCT Filed: Sep. 30, 1999

(86) PCT No.: PCT/FI99/00804

§ 371 (c)(1),
(2), (4) Date: Mar. 16, 2001

(87) PCT Pub. No.: WO00/18988

PCT Pub. Date: Apr. 6, 2000

(30) Foreign Application Priority Data

Sep. 30, 1998 (FI) ..... 982104

(51) Int. Cl.[7] ..... C25C 7/06

(52) U.S. Cl. ..... 204/297.08; 204/198; 204/222; 204/225; 204/297.01; 204/297.06; 204/297.07

(58) Field of Search ..... 204/198, 222, 204/225, 286.1, 288.6, 297.01, 297.06, 297.07, 297.08

(56) References Cited

U.S. PATENT DOCUMENTS

| | | | | | |
|---|---|---|---|---|---|
| 3,707,764 | A | * | 1/1973 | Frankovich | 29/527.6 |
| 3,946,854 | A | * | 3/1976 | Kojima et al. | 198/431 |
| 4,028,211 | A | * | 6/1977 | Hirakawa et al. | 204/267 |
| 4,425,211 | A | * | 1/1984 | Birkle et al. | 204/198 |
| 5,244,559 | A | * | 9/1993 | Latz | 204/298.09 |
| 5,702,582 | A | * | 12/1997 | Goldstein et al. | 204/632 |

* cited by examiner

*Primary Examiner*—Nam Nguyen
*Assistant Examiner*—Brian L Mutschler
(74) *Attorney, Agent, or Firm*—Morgan & Finnegan, L.L.P.

(57) ABSTRACT

The invention relates to a transverse conveyor for electrodes used in the production of metals. This transverse conveyor consists of a transfer device, located below the electrodes to be transferred and which device moves back and forth on a horizontal plane, as well as of lifters used for lifting the electrodes. The transfer device consists of a frame, on which there is a moving transfer bar, which is designed to cover the frame at all stages of its movement.

9 Claims, 1 Drawing Sheet

TRANSVERSE CONVEYOR FOR ELECTRODES

FIELD OF THE INVENTION

The present invention relates to a transverse conveyor for electrodes used in the production of metals. This transverse conveyor consists of a transfer device, located below the electrodes to be transferred, which device moves back and forth on a horizontal plane, as well as of lifters used for lifting the electrodes. The transfer device consists of a frame, on which there is a moving transfer bar, which is designed to cover the frame at all stages of its movement.

BACKGROUND OF THE INVENTION

In the electrolysis tankhouses used in the production of pure metals such as copper, zinc and nickel, a great number of electrodes, both anodes and cathodes, are handled. The volume of electrodes being handled means that handling is largely done with machines with which a considerable part of the operations is transferring of electrodes from one work stage to another. Traditionally, chain or walking beam conveyors have been used for transferring electrodes. There have been continual problems with conventional conveyors, partly due to the conditions in electrolysis and partly due to the actual construction of the conveyors.

The problems caused by conditions in electrolysis are usually related to either mechanical wear, due to dirt on the electrodes, or to the corrosive effects of the electrolyte. Conventional conveyors are normally poorly protected from these conditions.

A typical problem for chain conveyors is the stretching of the chain, which is further exacerbated by the general dirt and corrosion in electrolysis. This is a very significant problem in electrolysis machines because the electrodes should be brought exactly to the right place in each treatment stage, which only succeeds with conveyors where the distance between electrodes is always extremely accurate.

On the other hand, the normal construction used for walking beam conveyors is one where the electrode-moving element (the walking beam) both lifts up and makes the desired horizontal movement before it goes down and returns to its starting position. The lifting movement, when the walking beam lifts the electrodes onto it, must be done at exactly the same rate along the whole length of the walking beam due to the functioning of the mechanism, which in turn makes the apparatus heavy and complicated.

For the reasons above, present-day conveyor solutions are generally expensive, yet wear relatively quickly and thus need a lot of servicing.

SUMMARY OF THE INVENTION

The invention now presented will remove the disadvantages of the aforementioned apparatuses, in that the mechanisms and actuators of the developed transverse conveyor which normally become quickly dirty are protected from the effects of environment, and the spacing of the electrodes always remains the same. The transverse conveyor is formed of a transfer device, located below the electrodes to be transferred, which has a bar that moves back and forth on a horizontal plane as well as of lifters used for lifting the electrodes. The transfer bar moves only on a horizontal plane, whereby the actuators are simple, and no mechanical synchonisation between the movements is necessary. The transverse conveyor of is located below the electrodes that are to be transferred. The lifting of the electrodes from an infeed line to the transfer bar and from the transfer bar either to intermediate stations or a discharge line takes place by using lifters known before. The essential features of the invention will be made apparent in the attached claims.

The core of the transverse conveyor below the electrodes is a transfer device located underneath the electrodes, which transfer device moves back and forth in a movement corresponding to the transfer distance of the electrodes. The transfer device moves only on a horizontal plane, not vertically at all.

The transfer device consists of a frame fastened to the floor or to some part of the machine frame, and of a transfer bar which moves rested on the frame. The transfer bar is designed so that when seen from above it covers the frame completely and also the majority of the frame when viewed from the side. Thus the transfer bar protects the frame and the mechanisms between the bar and the frame from dirt and moisture. Between the transfer bar and the frame there is a bracing mechanism that enables the controlled longitudinal movement of the bar. For example, this bracing may be a roller support and guide, slide bar support and guide or a combination of these.

The construction of the transfer bar of the transfer device is formed so as always to cover the frame completely. This occurs for example so that the length of the transfer bar is equal to the combined length of the frame and the transfer distance, whereby the transfer bar when moving always covers the frame completely even at both extreme positions. Another alternative is that the length of the transfer bar is essentially the length of the frame and the emerging end of the frame and mechanisms are protected with bellows or other suitable structures.

The transfer bar is moved back and forth with a purpose-built actuator known before, such as a hydraulic cylinder or gear rack and pinion drive.

In addition to the transfer device, a sufficient amount of electrode lifters also belong to the transverse conveyor. Lifters are needed in each intermediate station of the transverse conveyor, but when using a chain conveyor, an electrode is lifted up as well from the chain for handling in an intermediate station, so that there is little additional need for lifters.

No separate lifters are required for the infeed and discharge end of the transfer device, as long as the electrode is brought to and taken from the transverse conveyor using a feeder combining vertical and horizontal movement, as is generally the case.

BRIEF DESCRIPTION OF THE DRAWINGS

The principle of the transverse conveyor under the electrodes according to this invention is described in more detail in the attached FIG. 1, in which the various operating stages a–e are presented in FIGS. 1*a–e* one below the other. The basic diagram (FIGS. 1*a–e*) shows the line seen as a side view and at the right of this figure is the same situation seen from the end of the line as FIGS. 1*a′–e′*.

DETAILED DESCRIPTION OF THE INVENTION

Figure 1A:
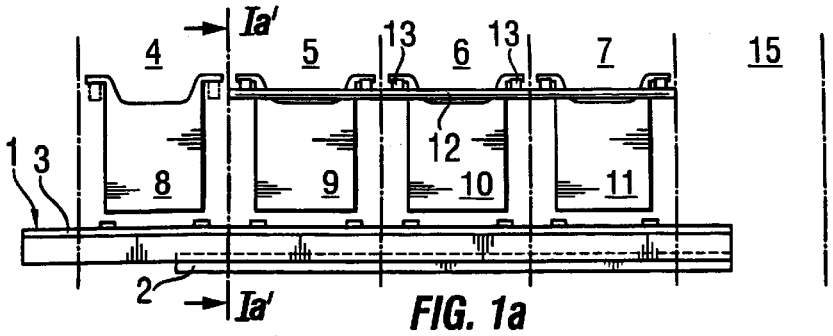
Figure 1A:
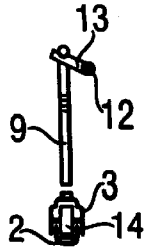

In stage a, described in FIG. 1*a*, the transfer device 1 of the transverse conveyor is ready to begin its operating cycle. The transfer device consists of a solid frame 2 and a moving transfer bar 3, located on top of the frame. An infeed line is described with number 4. At intermediate stations 5, 6 and 7, electrodes 8, 9, 10 and 11 are all supported by lifters 12 of the transverse conveyor (not shown in detail). One lifter hook 13 can be seen in the FIG. 1*a*'. It can also be seen in figures a'–e' that the bracing mechanism of the transfer bar 3 and frame 2 of the transfer device is in this case provided by roller support 14.

Figure 1B:
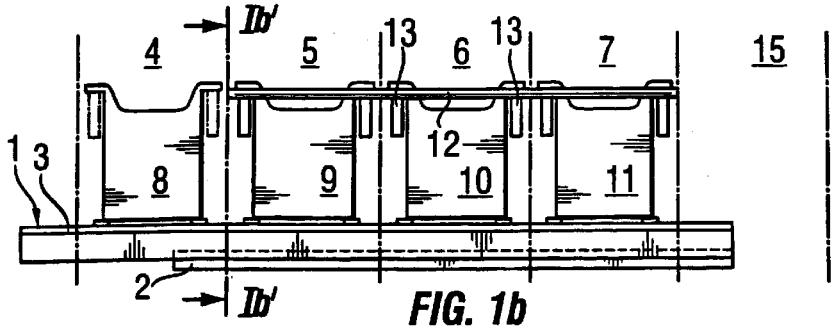
Figure 1B:
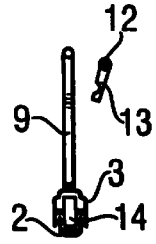
Figure 1C:
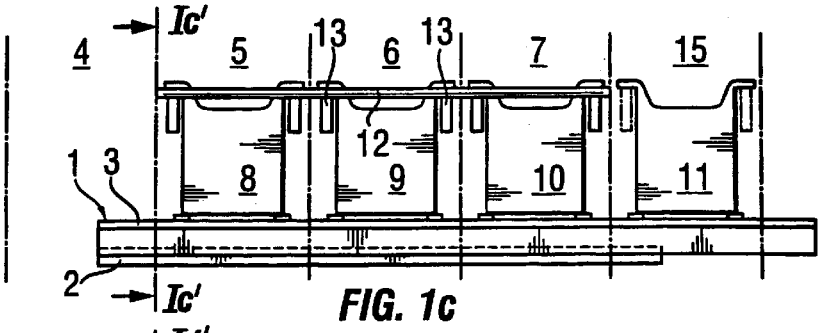
Figure 1C:
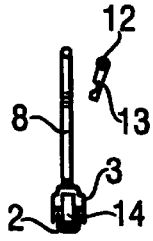
Figure 1D:
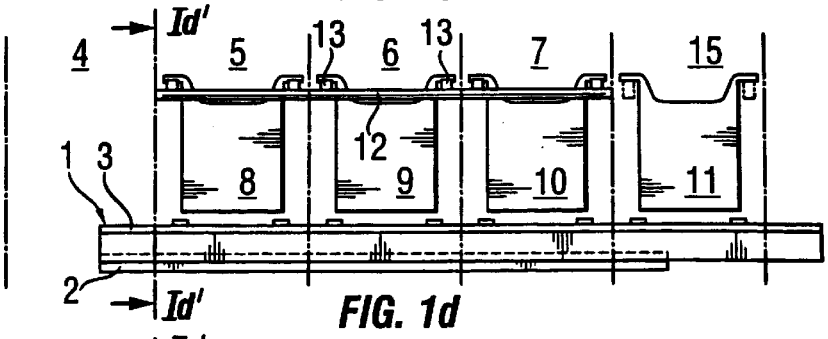
Figure 1D:
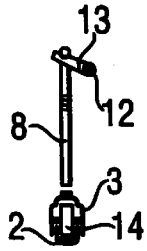
Figure 1E:
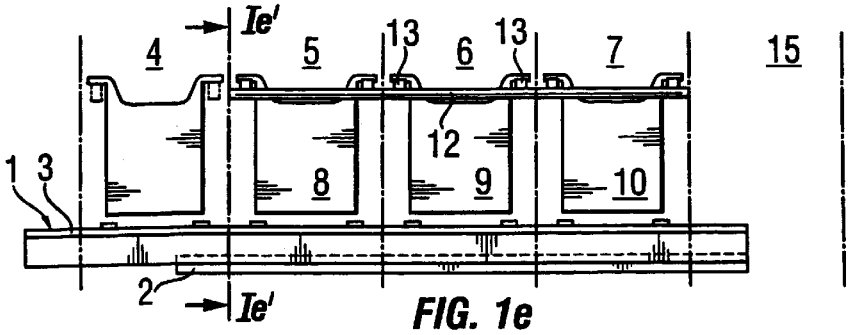
Figure 1E:
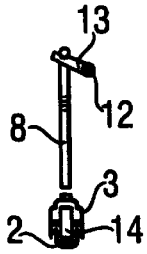

In stage b, described in FIG. 1*b*, a feeder (not shown) in the infeed line 4 settles a new electrode 8 to the first electrode position of the transfer bar of the transfer device, and at the same time the intermediate station lifters settle electrodes 9, 10 and 11 to the intermediate electrode positions of the transfer device. This is also seen in FIG. 1*b*'. In FIG. 1*c*, which describes stage c, the transfer bar moves horizontally a distance of one electrode spacing towards the discharge line 15 and transfers at the same time the electrodes on top of it the same distance. In stage d, FIG. 1*d*, a feeder (not shown) in the discharge line 15 lifts the electrode which lies in the last electrode position of the transfer bar, off from the top of the transfer bar, and lifters of the intermediate stations lift up the electrodes at the intermediate stations. In stage e, FIG. 1*e*, the transfer bar returns without load and is again ready to begin a new operating cycle.

The transverse conveyor described above has clear advantages compared with the apparatuses described in the prior art: The actuators and mechanisms of the transverse conveyor are protected from the effects of the environment such as dirt and corrosion. The spacing between electrodes always remains exactly the same. As the horizontal and vertical movements are differentiated with their own units in the apparatus developed, the actuators are simple and no mechanical synchronisation between the movements is required. The number of moving parts and mechanisms in the apparatus is small. It is easy to make a strong, long-lasting and cheap construction with low maintenance requirements.

What is claimed is:

1. A transverse conveyor for electrodes used in the production of metals, comprising a transfer device, located below the electrodes to be transferred, the transfer device moving back and forth on a horizontal plane, transverse to a longitudinal axis of each electrode; and lifters for lifting a pre-selected number of the electrodes off of the transfer device at a first position, and for returning the pre-selected number of electrodes to the transfer device at a second position, the second position offset a pre-selected distance along the horizontal plane from the first position.

2. A transverse conveyor according to claim 1, wherein the transfer device is formed of a frame, and a transfer bar that moves on top of the frame, the transfer bar covering the entire frame at each stage of movement of the transfer bar.

3. A transverse conveyor according to claim 2, wherein the length of the transfer bar is equal to the length of the frame plus a transfer distance of the transfer bar.

4. A transverse conveyor according to claim 2, wherein the length of the transfer bar is essentially the length of the frame, the transfer bar being equipped with bellows at each end to protect the frame.

5. A transverse conveyor according to claim 2, wherein the transfer bar is supported on the frame by means of a roller support.

6. A transverse conveyor according to claim 2, wherein the transfer bar is supported on the frame by means of a slide rail support.

7. A transverse conveyor according to claim 1, wherein a hydraulic cylinder is used as an actuator of the transfer device.

8. A transverse conveyor according to claim 1, wherein a gear rack and pinion drive is used as an actuator of the transfer device.

9. A transverse conveyor according to claim 1, wherein an infeed line of the electrodes, intermediate stations and a discharge line are equipped with lifters or feeders with a vertical movement.

* * * * *